US011259582B2

(12) United States Patent
Efrat

(10) Patent No.: US 11,259,582 B2
(45) Date of Patent: Mar. 1, 2022

(54) CLOTHING ACCESSORY FOR HOLDING FOLDS OR ROLL-UPS OR PULL-UPS IN CLOTHES WORN BY WEARER

(71) Applicant: Eliahu Efrat, Lexington, MA (US)

(72) Inventor: Eliahu Efrat, Lexington, MA (US)

( * ) Notice: Subject to any disclaimer, the term of this patent is extended or adjusted under 35 U.S.C. 154(b) by 117 days.

(21) Appl. No.: 16/669,661

(22) Filed: Oct. 31, 2019

(65) Prior Publication Data

US 2020/0068967 A1 Mar. 5, 2020

(51) Int. Cl.
*A41D 27/08* (2006.01)

(52) U.S. Cl.
CPC ..... *A41D 27/08* (2013.01)

(58) Field of Classification Search
CPC . A41D 27/08; A41F 1/00; A41F 17/02; A44B 6/00; A44B 99/00
See application file for complete search history.

(56) References Cited

U.S. PATENT DOCUMENTS

| | | | | | |
|---|---|---|---|---|---|
| 883,231 | A * | 3/1908 | Pilkington | A41F 1/00 | 24/540 |
| 1,381,846 | A * | 6/1921 | Maker | A44B 6/00 | 24/66.13 |
| 6,161,224 | A * | 12/2000 | Tuetken | A41D 27/08 | 2/244 |
| 6,298,526 | B1 * | 10/2001 | Baumdicker | A44B 99/00 | 24/306 |
| D453,294 | S * | 2/2002 | Bitzer | D8/395 | |
| D485,162 | S * | 1/2004 | Wadsworth | D34/10 | |
| 6,675,449 | B2 * | 1/2004 | Wales | A44B 99/00 | 24/559 |
| D510,019 | S * | 9/2005 | Davis | D34/10 | |
| D537,329 | S * | 2/2007 | Blanton | D8/395 | |
| 8,881,350 | B2 * | 11/2014 | Pellei | A47K 10/025 | 24/545 |
| D888,608 | S * | 6/2020 | Spater | D11/215 | |
| D889,952 | S * | 7/2020 | Maurer | D8/394 | |
| 2003/0135959 | A1 * | 7/2003 | Wales | A44B 99/00 | 24/30.5 R |
| 2006/0213036 | A1 * | 9/2006 | Flowers | A41F 17/02 | 24/72.1 |

(Continued)

FOREIGN PATENT DOCUMENTS

| | | | | |
|---|---|---|---|---|
| GB | 266997 A * | 3/1927 | ..... | A44B 99/00 |

*Primary Examiner* — Robert Sandy
*Assistant Examiner* — Louis A Mercado
(74) *Attorney, Agent, or Firm* — Rumit Ranjit Kanakia

(57) ABSTRACT

A clothing accessory for holding folds/pull-ups/roll-ups in wearable clothes worn by clothing wearer. The clothing accessory having a single loop body that includes a top arm portion and a case arm portion. The top arm portion include a flat and straight configuration. The base arm portion includes a partially straight configuration, and a partially inclined configuration extending from the partially straight configuration and bends towards the top arm portion. The single loop body include a curved profile that seamlessly joins the top arm portion and the base arm portion to each other. The single loop body also include a tongue portion and a jaw profile. The tongue portion may extend from the partially inclined configuration from the base arm portion. The jaw profile extend upwardly from an underside of the top arm portion to engage with the tongue portion along a proximal end portion of the top arm portion.

18 Claims, 5 Drawing Sheets

(56) References Cited

U.S. PATENT DOCUMENTS

| | | | | |
|---|---|---|---|---|
| 2008/0289159 | A1* | 11/2008 | Solich | D06F 55/00 24/571 |
| 2011/0203035 | A1* | 8/2011 | Kim | A41F 19/005 2/255 |
| 2017/0303614 | A1* | 10/2017 | McMahon | D06F 55/00 |

* cited by examiner

CLOTHING ACCESSORY FOR HOLDING FOLDS OR ROLL-UPS OR PULL-UPS IN CLOTHES WORN BY WEARER

TECHNICAL FIELD OF THE INVENTION

The present invention generally relates to a clothing or fashion accessory that may be engaged with wearable clothes for convenience and/or utility and/or fashion purposes, and, more particularly, relates to clothing or fashion accessories that may be engaged with various clothes, such as shirts, tops, lowers or bottoms, sweatshirts, sweaters, etc., while the clothes are worn by clothing wearers, to clip and hold any folded or rolled up or pulled up portions, such as sleeves, sides or fronts, etc. thereof, and prevent thereto from dropping back down.

BACKGROUND OF THE INVENTION

Convenience, flexibility and choice have become an important part of our modern-day society. In clothing and fashion area, convenience, flexibility and choice are becoming ever more important to the clothing wearer, thus being able to deal with the problems of retaining folds or roll-ups or pull-ups associated with the wearable clothes while the clothes are worn by clothing wearers looks like a necessary clothing accessory for the clothing wearers.

More often than not, wearable clothes, such as, that are worn on the upper body portion, for example, tops, shirts, sweatshirts, sweaters, etc.; or that are worn on the lower body portion, for example, lowers, pants, skirts, are sometime required to be folded or rolled up or pulled up to shorten their length, either for convenience for doing some kind of work and avoid the clothes to be dirty or wet, or just for fashion purpose.

For example, while a clothing wearer has worn a sweatshirt having a long sleeve requires to get involved in some kind of work, such as, in a garden; it is very likely that in order to avoid the sleeves of the sweatshirt to become dirty from the soil in the garden, he/she may fold or roll up or pull up the long sleeve over his/her arm before starting to work with soil in the garden. However, it is also very likely that while working in the garden, his/her sleeve may drop back down and get dirty, or if not dirty, the dropped down sleeve may cause inconvenience to the clothing wearers while he/she is working in the garden. To avoid such inconvenience or the sleeve from being dirty, the clothing wearer must have to roll or pull back the sleeve again. If such folding and unfolding or rolling and unrolling or pulling and falling of the sleeve occur repeatedly, one can imagine the inconvenience and frustration of the clothing wearer as once the clothing wearer starts working in the garden or washing dishes, etc., and his/her hands get dirty or wet respectively, it is hard to roll, fold or pull the sleeves back up without getting the sleeve dirty or wet.

Such kind of situation may arise with any such wearable clothes with long lengths of sleeves of shirts, sweatshirts, or pants, lowers, or long lengths of top or back portions of shirts or skirts.

Further, many times, clothing wearers wearing a sweatshirt or shirt having a long sleeve may fold or roll up or pull up the sleeves above his/her arms just for fashion purpose to make a statement, if not required to work anywhere. During those times as well, sleeve may drop back down, and the clothing wearer has to repeatedly roll or pull or fold back the sleeve again and again. If such rolling and unrolling of the sleeve occurs repeatedly, the clothing wearer may have to compromise with their fashion statement.

Accordingly, a clothing or fashion accessory that may engage with various clothes, such as shirts, tops, lowers, sweatshirt, sweaters, etc., while the clothes are worn by clothing wearers, to clip and hold any folded, rolled up or pulled up portions, such as sleeves, sides or fronts, etc. thereof and prevent thereto from dropping back down looks like a necessary item for the clothing wearers, either for fashion purposes, or for doing some kind of work conveniently with folded, rolled up or pulled up sleeves.

SUMMARY OF THE INVENTION

In view of the foregoing disadvantages inherent in the prior art, the general purpose of the present invention is to provide a clothing or fashion accessory to include all advantages of the prior art, and to overcome the drawbacks inherent in the prior art.

An object of the present disclosure is to provide a clothing or fashion accessory that may engage with various clothes, such as shirts, tops, lowers, sweatshirt, sweaters, etc., while the clothes are worn by clothing wearers, to clip and hold any folded rolled up or pulled up portions, such as sleeves, sides or fronts, etc. thereof and prevent thereto from dropping back down looks like a necessary item for the clothing wearers, either for fashion purposes, or for doing some kind of work conveniently with folded, rolled up or pulled up sleeves.

In view of the above objects, generally, the present invention provides a clothing accessory for holding folds, roll-ups or pull-ups in wearable clothes worn by clothing wearer. The present invention provides a clothing or fashion accessory that may be capable of being engaged with various clothes, such as shirts, tops, lowers, sweatshirt, sweaters, etc., while the clothes are worn by clothing wearers, to clip and hold any folded or rolled up or pulled up portions, such as sleeves, sides or fronts, etc. thereof and prevent thereto from dropping back down, either for fashion purposes, or for doing some kind of work conveniently with folded or rolled up or pulled up sleeves or any other clothing portions.

In one aspect, the clothing accessory may comprise a single loop body. The single loop body of the clothing accessory may include having a top arm portion and a base arm portion. The top arm portion may include a flat and straight configuration. Further, the base arm portion may include a partially straight and a partially inclined configuration. The partially inclined configuration extends from the partially straight configuration. The partially inclined configuration bends towards the top arm portion. The single loop body of the clothing accessory may further include a curved profile that seamlessly joins the top arm portion and the base arm portion to each other. Furthermore, the single loop body of the clothing accessory may also include a tongue portion and a jaw profile. The tongue portion may extend from the partially inclined configuration from a proximal end portion of the base arm portion. Further, the jaw profile may extend upwardly from an underside of the top arm portion to engage with the tongue portion along a proximal end portion of the top arm portion. The single loop body of the clothing accessory may be clipped into the wearable clothes worn by the clothing wearers, holding folded, rolled-up and/or pulled-up clothes portion within a space between the top arm portion and the base arm portion. Further, the tongue portion may be engaged with the jaw profile such that the fabric of the wearable cloth worn by the clothing wearers lies between the tongue portion and the jaw profile, and that the tongue portion and the jaw profile safely grip the fabric of wearable clothes worn by clothing wearers below the rolled-up and/or pulled-up clothes portion to hold back the rolled-up and/or pulled-up clothes portion from dropping back down.

In one example embodiment, the single loop body may be of a flexible material to allow to-and-fro bending and opening movement to clip the wearable clothes. In another example, the single loop body may be of a thin metallic body. In one further example, the single loop body may be of a flexible plastic body. In one further example embodiment, the single loop body may be of a constant thickness along its entire length.

In one example embodiment, the jaw profile may include a bottom portion and a top portion. The bottom portion may extend upwardly from the underside of the top arm portion. Further, the top portion may be at a free end of the jaw profile. The bottom portion may include a thickness greater than a thickness of the top portion. In one arrangement, the jaw profile may include a barb portion at the top portion along the free end of the jaw profile to engage with the tongue portion. In one example arrangement, the jaw profile, from the bottom portion, may extend upwardly in a slanted orientation from the underside of the top arm portion.

In one embodiment, the partially straight and the tongue portion of the base arm portion may be parallel to the top arm portion.

In one embodiment, the clothing accessory may include one or more characters or designs or graphics on the upper side of the top arm portion.

In one embodiment, the clothing accessory may include an item coupled along the upper side of the top arm portion. In one example, the item may be coupled to the clothing accessory along the upper side of the top arm portion by one of a glue, weld, rivets and pins.

In one further aspect of the present disclosure, a method for making a clothing accessory is provided. The method includes obtaining a single loop body having a flexibility, to allow to-and-fro bending and opening movement to clip clothes. In one example embodiment, the single loop body having the flexibility may be obtained by molding a material including a plastic into the single loop body. In another example embodiment, the single loop body may be obtained by molding a material including a metal into the single loop body. In one another example embodiment, the single loop body having the flexibility may be obtained by bending a material including a thin metal strip of constant thickness and having a flexibility, into the single loop body.

In one embodiment, the method includes forming one or more characters or designs or graphics on the single loop body. In another embodiment, the method further includes coupling an item on the single loop body. In such embodiment, the item may be coupled to the single loop body by one of a glue, weld, rivets and pins.

In one further aspect of the present disclosure, a method for using a clothing accessory for holding folds and/or roll-ups and/or pull-ups in wearable clothes worn by clothing wearers is provided. As described above, the clothing accessory may include the single loop body having the top arm portion and the base arm portion, and the tongue portion and the jaw profile. The method steps includes: folding and/or rolling up or pulling up a portion of the wearable clothes worn by the clothing wearers; clipping the single loop body of the clothing accessory into the wearable clothes worn by the clothing wearers, holding folded, rolled-up and/or pulled-up clothes portion within a space between the top arm portion and the base arm portion, and engaging the tongue portion with the jaw profile such that the fabric of the wearable cloth worn by the clothing wearers lies between the tongue portion and the jaw profile, and that the tongue portion and the jaw profile safely grip the fabric of wearable clothes worn by clothing wearers above the rolled-up and/or pulled-up clothes portion to hold back the rolled-up and/or pulled-up clothes portion from dropping back down and without causing any damage to the fabric.

This together with the other aspects of the present invention, along with the various features of novelty that characterize the present invention, is pointed out with particularity in the claims annexed hereto and forms a part of the present invention. For a better understanding of the present invention, its manufacturing and operating advantages, and the specified object attained by its uses, reference should be made to the accompanying drawings and descriptive matter in which there are illustrated exemplary embodiments of the present invention.

BRIEF DESCRIPTION OF THE DRAWINGS OF THE INVENTION

The advantages and features of the present invention will become better understood with reference to the following detailed description and claims taken in conjunction with the accompanying drawings, wherein like elements are identified with like symbols, and in which:

Figure 1:
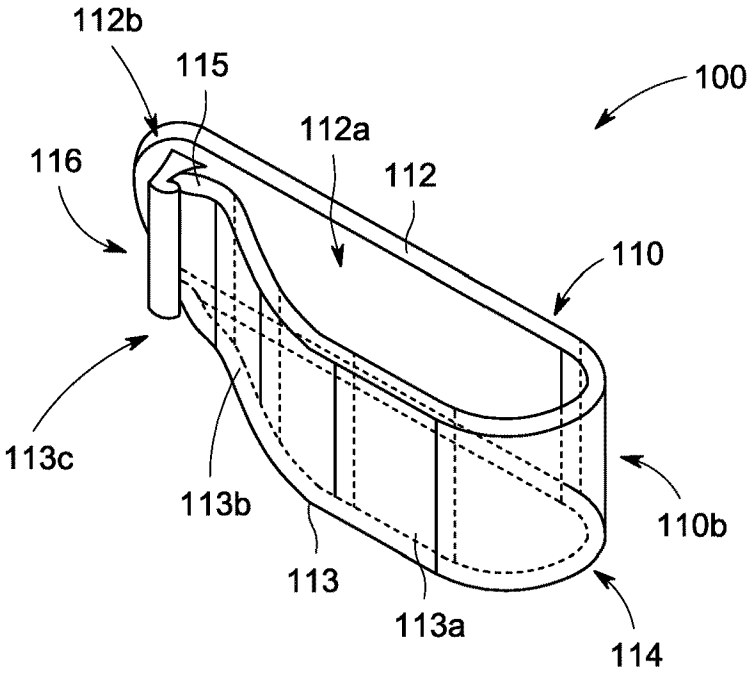
FIG. 1 illustrates an isometric view of a clothing accessory for holding folds/roll-ups/pull-ups in wearable clothes worn by a clothing wearer, in accordance with an exemplary embodiment of the present disclosure.
Figure 4A:
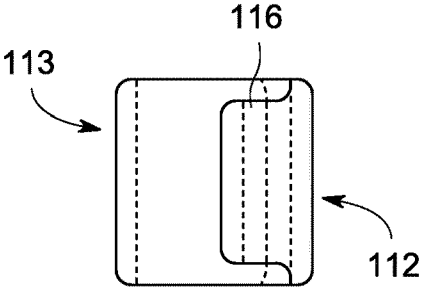
Figure 4B:
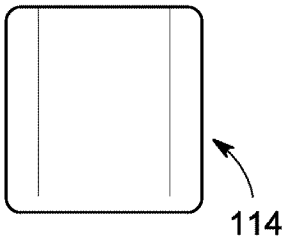
Figure 6A:
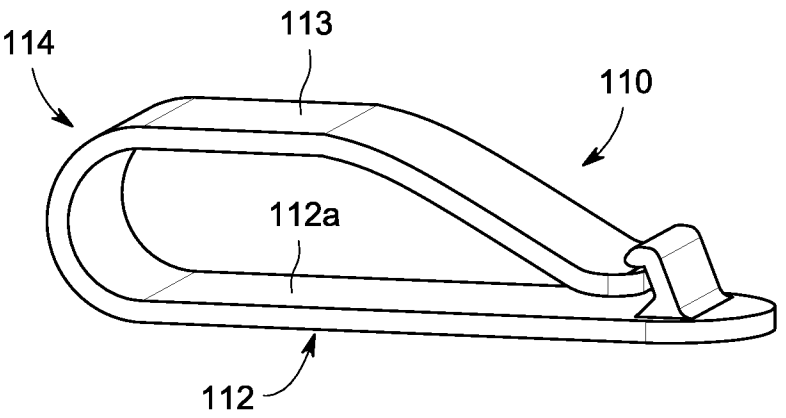
Figure 6B:
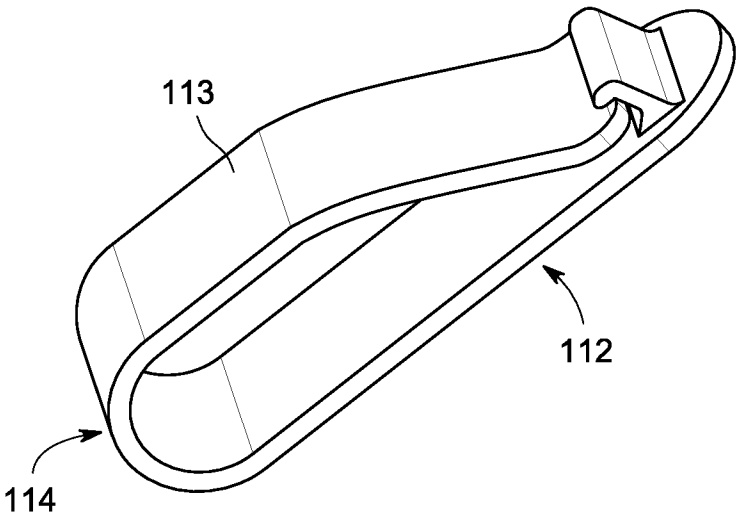
Figure 5A:
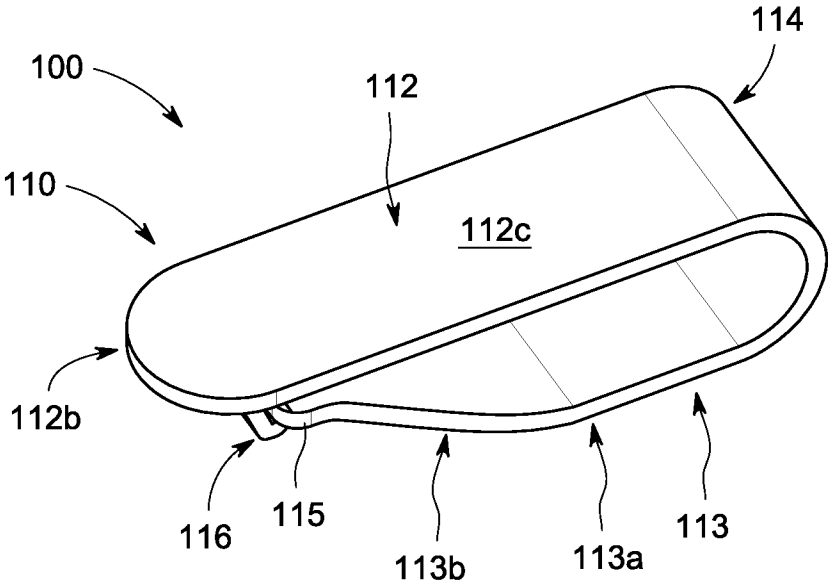
Figure 5B:
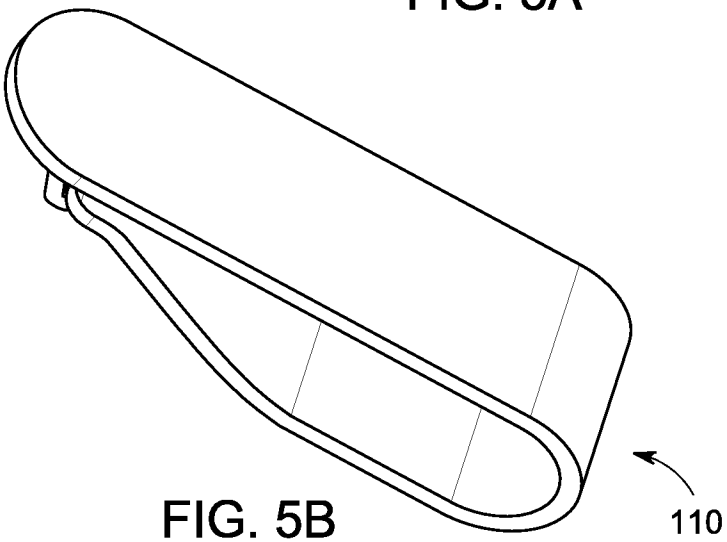
Figure 7:
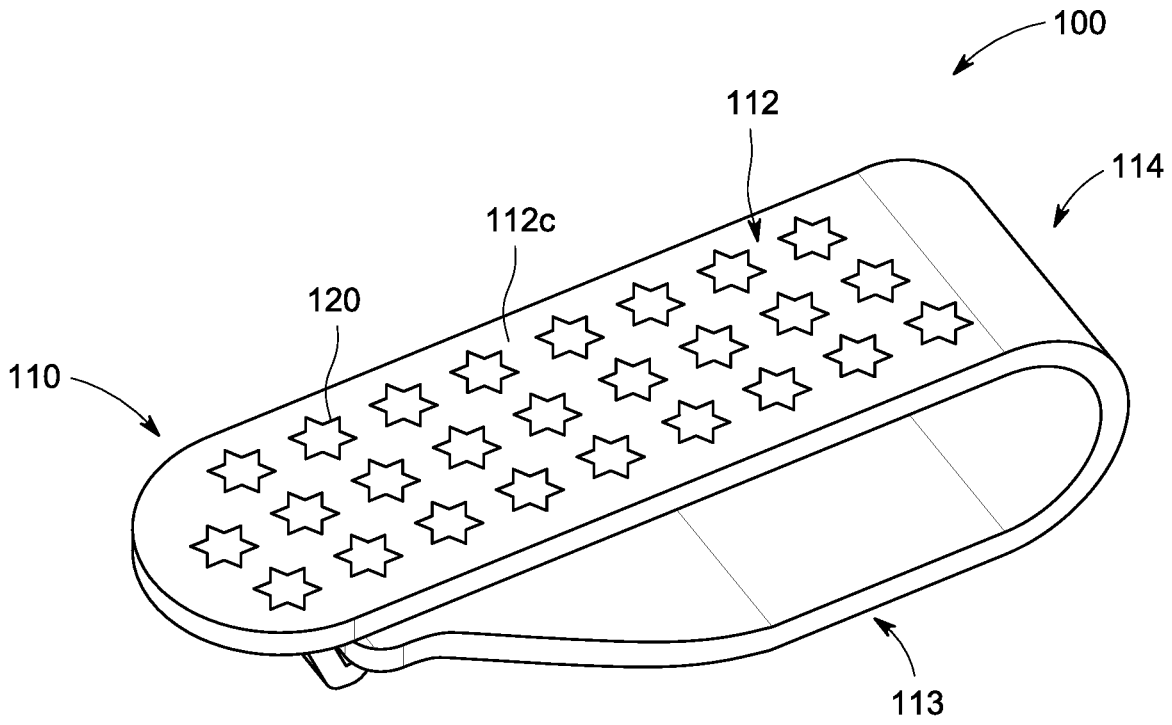
Figure 8:
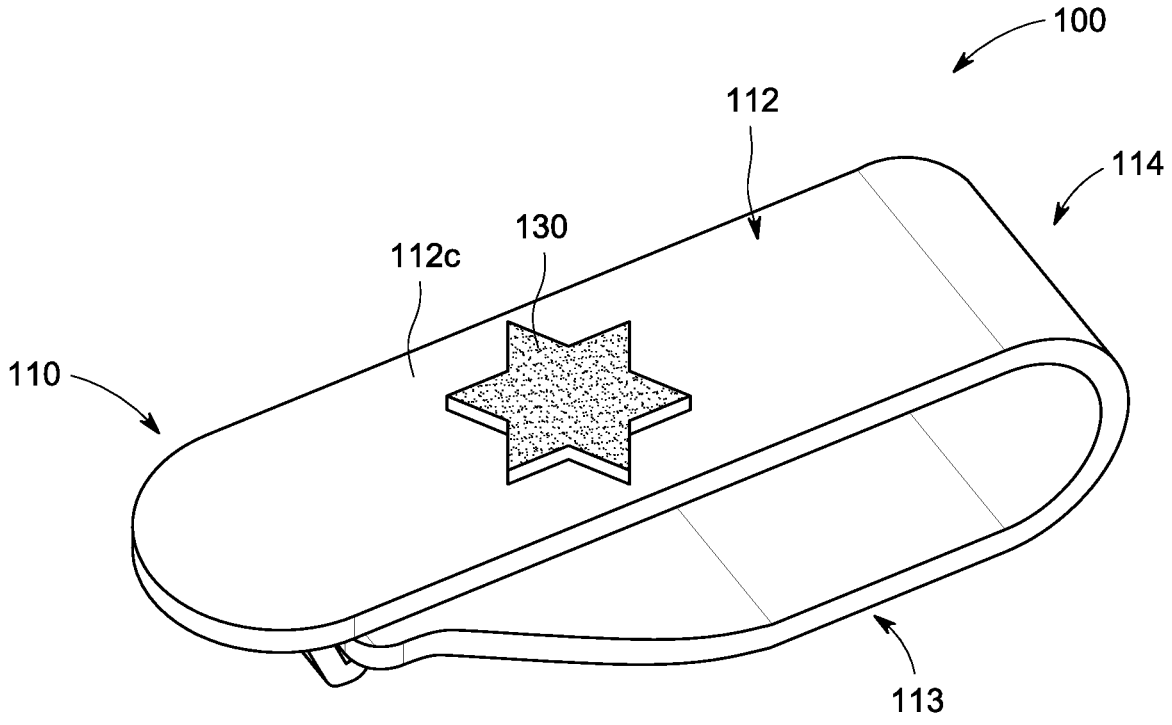
Figure 9:
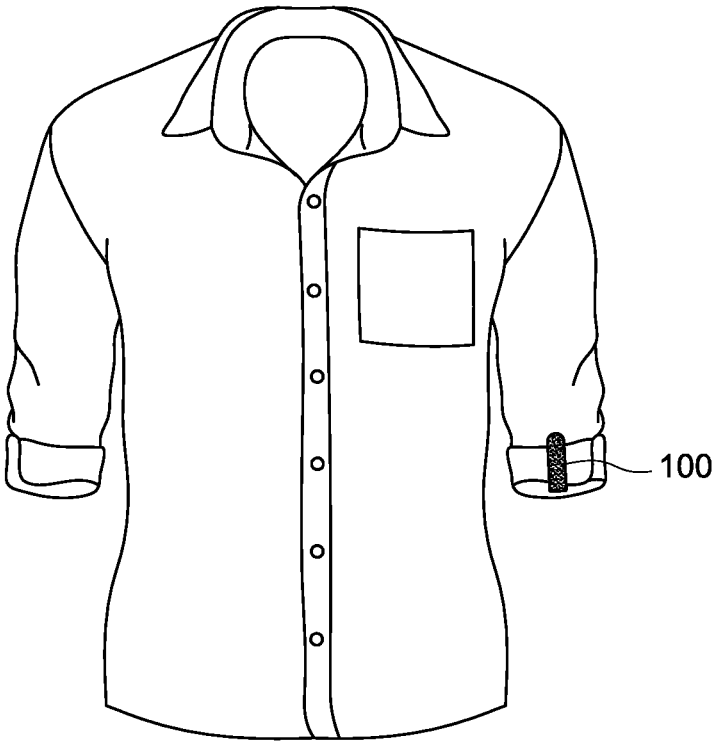
Figure 10:
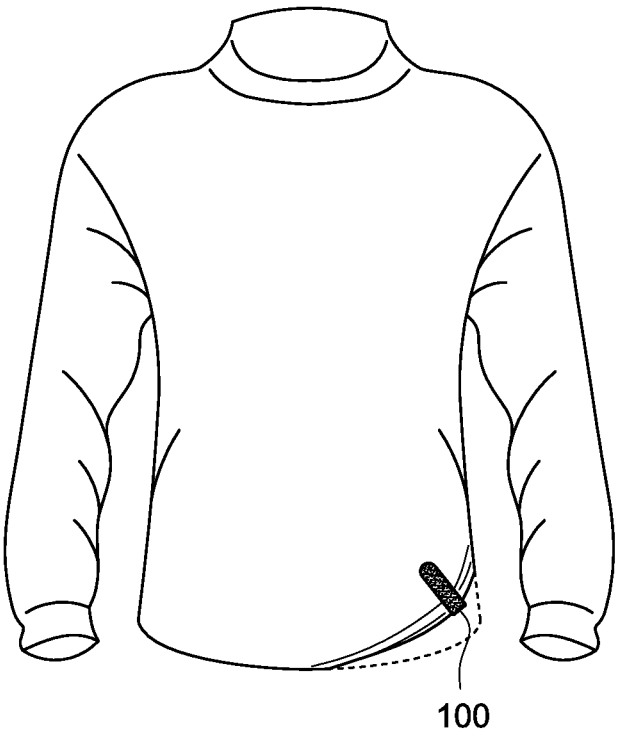
Figure 11:
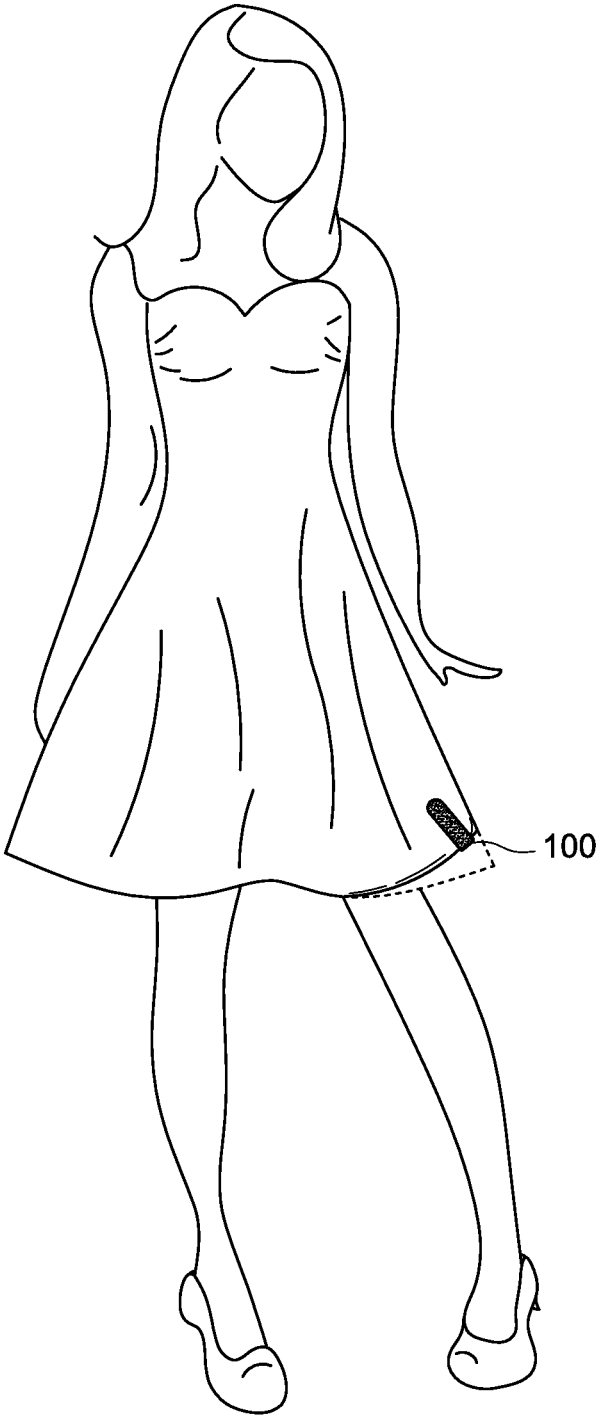

FIGS. 4*a* and 4*b*, respectively, illustrate a front and back view of a clothing accessory of FIG. 1, in accordance with an exemplary embodiment of the present disclosure;

FIGS. 5A and 5B illustrate solid perspective views of clothing accessories when seen from top front side, in accordance with an exemplary embodiment of the present disclosure;

FIGS. 6A and 6B illustrate solid perspective views of clothing accessories when seen from bottom front side, in accordance with an exemplary embodiment of the present disclosure;

FIG. 7 illustrates a decorative clothing accessory which includes a design graphics on the upper side of the top arm portion, in accordance with an exemplary embodiment of the present disclosure;

FIG. 8 illustrates a clothing accessory having an item coupled thereto to enhance its decorative visibility, in accordance with an exemplary embodiment of the present disclosure;

FIG. 9 illustrates a clothing accessory engaged with wearable clothes worn by clothing wearer for holding folds or roll-ups or pull-ups of the sleeve of the wearable clothes, in accordance with an exemplary embodiment of the present disclosure;

FIG. 10 illustrates a clothing accessory engaged with wearable clothes worn by clothing wearer for holding folds or roll-ups or pull-ups of long front or back portions of wearable clothes, for example long front or back portions of top or shirt, in accordance with an exemplary embodiment of the present disclosure; and FIG. 11 illustrates a clothing accessory engaged with wearable clothes worn by clothing wearer for holding folds or roll-ups or pull-ups of long front or back portions of wearable clothes, for example long front or back portions of skirts or pants, in accordance with an exemplary embodiment of the present disclosure.

Like reference numerals refer to like parts throughout the description of several views of the drawings.

DETAILED DESCRIPTION OF THE EMBODIMENTS OF THE INVENTION

For a thorough understanding of the present invention, reference is to be made to the following detailed description, including the appended claims, in connection with the above-described drawings. Although the present invention is described in connection with exemplary embodiments, the present invention is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The terms, "a" and "an" herein do not denote a limitation of quantity, but rather denote the presence of at least one of the referenced items.

The present invention pertains to a clothing accessory for holding folds, roll-ups and/or pull-ups in wearable clothes worn by a clothing wearer. The present invention pertains to a clothing or fashion accessory that may be capable of being engaged with various clothes, such as shirts, tops, lowers, sweatshirt, sweaters, etc., while the clothes are worn by clothing wearers, to clip and hold any folded, rolled up and/or pulled up portions, such as sleeves, sides or fronts, etc. thereof and prevent thereto from dropping back down, either for fashion purposes, or for doing some kind of work conveniently with folded or rolled-up or pulled-up sleeves or any other clothing portions.

The terms such as "fold" or "folds" or "folded" used herein in view to define any kind of arrangement that shortens the length of any portions, such as sleeve or any other parts of wearable clothes worn by clothing wearer. Such terms also define to include "roll-up" or "pull-up" of the sleeve or any other portion of the wearable clothes, and thus these terms are used combinedly or interchangeably throughout the specification.

The present invention eliminates the inconvenience and frustration associated with the clothing wearer who has to roll back the sleeve or any other clothing portions again and again. The clothing accessory of the present invention is very useful and functional in terms of perfectly holding the folded, rolled-up and/or pulled-up portions of the clothes while the cloth is worn by the clothing wearer. Further, the clothing accessory of the present invention is very affordable and a no-brainer purchase as it is made of a single mold and of easily available plastics or thin metal having enough flexibility. Being of low cost and affordable, the clothing accessory of the present invention is also very marketable as a give-away by brands.

The clothing accessory of the present invention offers unanswered solutions to the clothing wearer who have to roll back the sleeve or any other clothing portions again and again in a very easy, comfortable and affordable manner as the clothing accessory of the present invention is easy to wear; and may come is various configurations as it is very low-cost but sturdy and simple to use. The clothing accessory of the present invention may be used by all age groups, including adults, teens, and kids, male or female, for their everyday work or for any other special occasions of family or business functions.

In one embodiment, the clothing accessory of the present invention may be of a clip form that is capable of holding rolled-up, pulled-up and/or folded clothes, such as shirts, sweatshirts and sweaters sleeves and prevent them from dropping back down. Such clip of the present invention may be capable of holding thin enough sweatshirts as well as sleeves of button-down shirts, which are folded, rolled up or pulled up and tend to drop back down. The clip may clip-on and thus be holding the folded/rolled-up/pulled-up sleeve in its place. Further, in one embodiment, the clothing accessory of the present invention may be made of material, which can be plastic, or thin metal so that its flexibility would allow it to bend open enough to clip onto the collected fabric and bend back and hold the fabric in its place.

Figure 2:
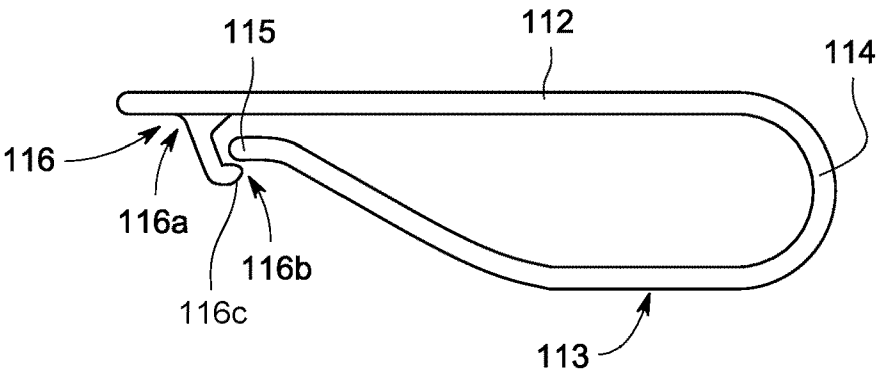
FIG. 2 illustrates a side view of a clothing accessory of FIG. 1, in accordance with an exemplary embodiment of the present disclosure.
Figure 3:
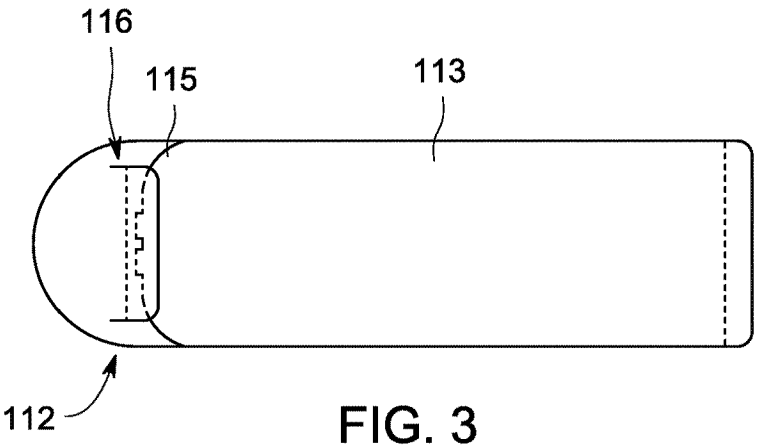
FIG. 3 illustrates a bottom view of a clothing accessory of FIG. 1, in accordance with an exemplary embodiment of the present disclosure.

As seen in FIGS. 1 to 6B, a clothing accessory (100) of the present invention is illustrated from various views and will be described in conjunction to FIGS. 1 to 6B. Specifically, FIG. 1 illustrates an isometric view of a clothing accessory (100) for holding folds/roll-ups/pull-ups in wearable clothes worn by a clothing wearer, in accordance with an exemplary embodiment of the present disclosure. FIG. 2 illustrates a side view of the clothing accessory (100) of FIG. 1, in accordance with an exemplary embodiment of the present disclosure. FIG. 3 illustrates a bottom view of the clothing accessory (100) of FIG. 1, in accordance with an exemplary embodiment of the present disclosure. FIGS. 4*a* and 4*b*, respectively, illustrate a front and back view of the clothing accessory (100) of FIG. 1, in accordance with an exemplary embodiment of the present disclosure. FIGS. 5A and 5B illustrate solid perspective views of the clothing accessories (100) when seen from top front side, in accordance with an exemplary embodiment of the present disclosure. Further, FIGS. 6A and 6B illustrate solid perspective views of the clothing accessories (100) when seen from bottom front side, in accordance with an exemplary embodiment of the present disclosure.

In one embodiment of an example design of the clothing accessory 100 may comprise a single loop body 110, as seen in FIGS. 1 to 6B. In one example embodiment, the single loop body 110 may be of a flexible material to allow to-and-fro bending and opening movement to clip the wearable clothes. In another example, the single loop body 110 may be of a thin metallic body. In one further example, the single loop body 110 may be of a flexible plastic body. In one further example embodiment, the single loop body 110 may be of a constant thickness along its entire length. However, without departing from the scope of the present disclosure, the single loop body 110 may be of a variable thickness along its entire length.

The single loop body 110 of the clothing accessory 100 may include having a top arm portion 112 and a base arm portion 113. The top arm portion 112 may include a flat and straight configuration. Further, the base arm portion 113 may include a partially straight 113*a* and a partially inclined 113*b* configuration. The partially inclined configuration 113*b* extends from the partially straight configuration 113*a*. The partially inclined configuration 113*b* bends towards the top arm portion 112. In one embodiment, the partially straight 113*a* and the tongue portion 115 of the base arm portion 113 may be parallel to the top arm portion 112.

The single loop body 110 of the clothing accessory 100 may further include a curved profile 114 that seamlessly joins the top arm portion 112 and the base arm portion 113 to each other.

Furthermore, the single loop body 110 of the clothing accessory 100 may also include a tongue portion 115 and a jaw profile 116. The tongue portion 115 may extend from the partially inclined configuration 113*b* from a proximal end portion 113*c* of the base arm portion 113. Further, the jaw profile 116 may extend upwardly from an underside 112*a* of the top arm portion 112 to engage with the tongue portion 115 along a proximal end portion 112*b* of the top arm portion 112.

In one example embodiment, the jaw profile 116 may include a bottom portion 116*a* and a top portion 116*b*. The bottom portion 116*a* may extend upwardly from the underside 112*a* of the top arm portion 112. Further, the top portion 116*b* may be at a free end of the jaw profile 116. The bottom portion 116*a* may include a thickness greater than a thickness of the top portion 116*b*. The jaw profile 116 may include a barb portion 116*c* at the top portion 116*b* along the free end of the jaw profile 116 to engage with the tongue portion 115.

In one embodiment, the jaw profile 116, from the bottom portion 116*a*, may extend upwardly in a slanted orientation from the underside 112*a* of the top arm portion 112. However, without departing from the scope of the present disclosure, the jaw profile 116 may extend upwardly in a straight orientation from the underside 112*a* from the bottom portion 116*a* of the top arm portion 112.

The single loop body 110 of the clothing accessory 100 may be clipped onto the wearable clothes worn by the clothing wearers, holding folded, rolled-up and/or pulled-up clothes portion within a space (S) between the top arm portion 112 and the base arm portion 113. Further, the tongue portion 115 may be engaged with the jaw profile 116 such that the fabric of the wearable cloth worn by the clothing wearers lies between the tongue portion 115 and the jaw profile 116, and that the tongue portion 115 and the jaw profile 116 safely grip the fabric of wearable clothes worn by clothing wearers below the rolled-up and/or pulled-up clothes portion to hold back the rolled-up and/or pulled-up clothes portion from dropping back down and without harming the fabric of the cloths.

In one embodiment, the clothing accessory 100 may be plain and simple without any design or graphics on its surface.

In another embodiment, as seen in FIG. 7, the clothing accessory 100 may include one or more characters or designs or graphics 120 on the upper side 112*c* of the top arm portion 112. In such embodiment, the clothing accessory 100 may be a decorative clothing accessory, in accordance with an exemplary embodiment of the present disclosure as disclosed in FIG. 7. In such embodiment, the clothing accessory 100 may include various designs or graphics 120 to enhance its visibility and beauty to meet the requirement of various age groups, including kids, adults, male, female, etc. In various embodiments, the clothing accessory 100 may include various famous cartoon characters that are appealing to kids of various age groups, inducing, toddlers, infants, kids, teens, etc. In further embodiment, the clothing accessory 100 may be of various colors to appeal to various adults, kids, male and female age group. Without departing from the scope of the present disclosure, the clothing accessory 100 may include various other graphic, colors, images to appeal to all the age groups and to provide variety of choices to the masses.

In another embodiment, the clothing accessory 100 may include an item 130 coupled thereto to enhance its decorative visibility, in accordance with an exemplary embodiment of the present disclosure as illustrated in FIG. 8. In such embodiment, the item 130 may be coupled along the upper side 112*c* of the top arm portion 112. In one example, the item 130 may be coupled to the clothing accessory 100 along the upper side 112*c* of the top arm portion 112 by one of a glue, weld, rivets and pins.

Such a separate design item 130 may be added or coupled to the clothing accessory 100 along its top arm portion 112, again to enhance its visibility, beatification and increasing style statement for fashion purposes or brand statement for advertising purposes. Such separate design item 130 may be of various shapes and sizes, and may include famous characters, cartoons, images, logos, etc.

However, without departing from the scope of the present disclosure, the clothing accessory 100 of the present invention may also have a place to print a logo or a flag or any small icon or image on it. This creates a noticeable accessory which has the capacity to display an image. This is applicable to logos, flags or any other images. In the logos scenarios, for example, the clothing accessory 100 may be used as giveaways at tradeshows. Such clothing accessory 100 may be low cost, small, come in any color, and bearers of the logo—perfect for a company giveaway at a trade show.

The clothing accessory 100 of the present disclosure with such place to print a logo or a flag or any small icon or image on it may be capable of making a statement—i.e. place an image of a flag and make a statement of support to the country of the flag, a university, a sports team, etc. Such design item may be made of various materials, including plastics, metal, wood store, fabrics, etc., or may be made of magnets etc. Further, the size and shape of the clothing accessory 100 may be accommodated as per the users' requirement and/or the amount of fabric to be collected in space 'S' between the top arm portion 112 and the base arm portion 113.

In one further embodiment of the present disclosure, a method for making a clothing accessory, such as clothing accessory 100, is disclosed. The method includes obtaining a single loop body, such as the single loop body 110, having a flexibility, to allow to-and-fro bending and opening movement to clip clothes. In one example embodiment, the single loop body having the flexibility may be obtained by molding a material including a plastic into the single loop body 110. In another example embodiment, the single loop body 110 may be obtained by molding a material including a metal into the single loop body. In one another example embodiment, the single loop body 110 having the flexibility may be obtained by bending a material including a thin metal strip of constant thickness and having a flexibility, into the single loop body 110.

In one embodiment, the method includes forming one or more characters or designs or graphics, such as characters or designs or graphics 120 on the single loop body 110. In another embodiment, the method further includes coupling an item, such as the item 130 on the single loop body 110. In such embodiment, the item 130 may be coupled to the single loop body 110 by one of a glue, weld, rivets and pins.

In one further embodiment of the present disclosure, a method for using a clothing accessory for holding folds and/or roll-ups or pull-ups in wearable clothes worn by clothing wearers is provided. As described above, the clothing accessory may include the single loop body 110 having the top arm portion 112 and the base arm portion 113, and the tongue portion 115 and the jaw profile 116. The method includes folding and/or rolling-up and/or pulling-up a portion of the wearable clothes worn by the clothing wearers. Further, the single loop body 110 of the clothing accessory 100 may be clipped into the wearable clothes worn by the clothing wearers, holding folded, rolled-up and/or pulled-up clothes portion within the space 'S' between the top arm portion 112 and the base arm portion 113. Clipping of the clothing accessory 100 enables the engagement of the tongue portion 115 with the jaw profile 116 such that the fabric of the wearable cloth worn by the clothing wearers lies between the tongue portion 115 and the jaw profile 116. The tongue portion 115 and the jaw profile 116 safely grip the fabric of wearable clothes worn by clothing wearers below the rolled-up and/or pulled-up clothes portion to hold back the rolled-up and/or pulled-up clothes portion from dropping back down.

In various embodiments, the clothing accessory 100 may be used to prevent any folded, rolled-up and/or pulled-up portions of the clothes worn by the clothing wearer from dropping back down, either for fashion purposes, or for doing some kind of work conveniently with a folded, rolled-up or pulled-up sleeve or any other clothing portions. Various examples are illustrated in FIGS. 9 to 11. For example, FIG. 9 illustrates the clothing accessory 100 engaged with wearable clothes worn by clothing wearer for holding folds, roll-ups and/or pull-ups of the sleeves of the wearable clothes. FIG. 10 illustrates the clothing accessory 100 engaged with wearable clothes worn by clothing wearer for holding folds, roll-ups or pull-ups of long front or back portions of wearable clothes, for example long front or back portions of top or shirt. FIG. 11 illustrates the clothing accessory 100 engaged with wearable clothes worn by clothing wearer for holding folds, roll-ups and/or pull-ups of long front or back portions of wearable clothes, for example long front or back portions of skirts or pants.

In one embodiment, use as illustrated in FIGS. 9 to 11, may be easily and comfortably operated by the clothing wearers. While using, such the single loop body 110 of the clothing accessory 100 with the base arm portion 113, the top arm portion 112, the curved profile 114, the tongue portion 115 and the jaw profile 116 facilitate above mentioned advantageous features of comfortably, conveniently and safely holding folds, roll-ups and/or pull-ups in wearable clothes worn by clothing wearers. The single loop body 110 of the clothing accessory may be clipped into the fabric of the cloth worn by the clothing wearers, for example, holding the folded, rolled-up and/or pulled-up sleeves within the space 'S' between the top and the base arms 112, 113. Furthermore, the tongue portion 115 and the jaw profile 116 safely grip the fabric below the folded/rolled-up/pulled-up portion of the sleeves and hold back the sleeve or any other clothing portions from dropping back down.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, to thereby enable others skilled in the art to best utilize the present invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present invention.

What is claimed is:

1. A clothing accessory for holding folds and/or roll-ups and or pull-ups in wearable clothes worn by clothing wearers, the clothing accessory comprising:

a single loop body having:

a top arm portion having flat and straight configuration;

a base arm portion having a partially straight and a partially inclined configuration, the partially inclined configuration extending from the partially straight configuration, the partially inclined configuration bent towards the top arm portion;

a curved profile joining the top arm portion and the base arm portion;

a tongue portion extending from the partially inclined configuration from a proximal end portion of the base arm portion; and a jaw profile extending upwardly from an underside of the top arm portion to engage with the tongue portion along a proximal end portion of the top arm portion, wherein the jaw profile comprises:

a bottom portion that extends upwardly from the underside of the top arm portion; and a top portion at a free end of the jaw profile, wherein the bottom portion comprises a thickness greater than a thickness of the top portion wherein the single loop body of the clothing accessory is clipped into the wearable clothes worn by the clothing wearers, holding folded, rolled-up and/or pulled-up clothes portion within a space between the top arm portion and the base arm portion, and wherein the tongue portion is engaged with the jaw profile such that a fabric of the wearable cloth worn by the clothing wearers lies between the tongue portion and the jaw profile, and that the tongue portion and the jaw profile safely grip the fabric of the wearable clothes worn by the clothing wearers below the rolled-up and/or pulled-up clothes portion to hold back the rolled-up and/or pulled-up clothes portion from dropping back down.

2. The clothing accessory as claimed in claim 1, wherein the single loop body is of a flexible material to allow to-and-fro bending and opening movement to clip the wearable clothes.

3. The clothing accessory as claimed in claim 1, wherein the single loop body is of a thin metallic body.

4. The clothing accessory as claimed in claim 1, wherein the single loop body is of a flexible plastic body.

5. The clothing accessory as claimed in claim 1, wherein the single loop body comprises a constant thickness along its entire length.

6. The clothing accessory as claimed in claim 1, wherein the jaw profile, from the bottom portion, extends upwardly in a slanted orientation from the underside of the top arm portion.

7. The clothing accessory as claimed in claim 1, wherein the jaw profile comprises a barb portion at the top portion along the free end of the jaw profile to engage with the tongue portion.

8. The clothing accessory as claimed in claim 1, wherein the partially straight and the tongue portion of the base arm portion is parallel to the top arm portion.

9. The clothing accessory as claimed in claim 1 further comprising one or more characters or designs or graphics on an upper side of the top arm portion.

10. The clothing accessory as claimed in claim 1 further comprising an item coupled along an upper side of the top arm portion.

11. The clothing accessory as claimed in claim 10, wherein the item is coupled to the clothing accessory along the upper side of the top arm portion by one of a glue, weld, rivets and pins.

12. A method for making a clothing accessory, the method comprising:

obtaining a single loop body having a flexibility, to allow to-and-fro bending and opening movement to clip clothes, wherein the single loop body comprises:

a top arm portion having flat and straight configuration;

a base arm portion having a partially straight and a partially inclined configuration, the partially inclined configuration extending from the partially straight configuration, the partially inclined configuration bent towards the top arm portion;

a curved profile joining the top arm portion and the base arm portion;

a tongue portion;

obtaining a jaw profile extending upwardly from an underside of the top arm portion to engage with the tongue portion along a proximal end portion of the top arm portion, wherein the jaw profile comprises:

a bottom portion that extends upwardly from the underside of the top arm portion; and a top portion at a free end of the jaw profile, wherein the bottom portion comprises a thickness greater than a thickness of the top portion.

13. The method as claimed in claim 12, wherein obtaining the single loop body having the flexibility comprises:

molding a material including a plastic into the single loop body.

14. The method as claimed in claim 12, wherein obtaining the single loop body having the flexibility comprises:

molding a material including a metal into the single loop body.

15. The method as claimed in claim 12, wherein obtaining the single loop body having the flexibility comprises:

bending a material including a thin metal strip of constant thickness and having a flexibility, into the single loop body.

16. The method as claimed in claim 12, further comprising forming one or more characters or designs or graphics on the single loop body.

17. The method as claimed in claim 12, further comprising coupling an item on the single loop body.

18. The method as claimed in claim 17, wherein the item is coupled to the single loop body by one of a glue, weld, rivets and pins.

* * * * *